US009306325B2

(12) United States Patent
Cheng

(10) Patent No.: US 9,306,325 B2
(45) Date of Patent: Apr. 5, 2016

(54) PLUG, SOCKET AND THEIR COMBINED STRUCTURE OF ELECTRICAL CONNECTOR

(71) Applicant: Cho-Yao Cheng, Dongguan (CN)

(72) Inventor: Cho-Yao Cheng, Dongguan (CN)

( * ) Notice: Subject to any disclaimer, the term of this patent is extended or adjusted under 35 U.S.C. 154(b) by 0 days.

(21) Appl. No.: 14/218,834

(22) Filed: Mar. 18, 2014

(65) Prior Publication Data

US 2015/0270642 A1 Sep. 24, 2015

(51) Int. Cl.

| | |
|---|---|
| ***H01R 13/625*** | (2006.01) |
| ***H01R 13/627*** | (2006.01) |
| ***H01R 12/88*** | (2011.01) |
| *H01R 12/81* | (2011.01) |
| *H01R 13/24* | (2006.01) |

(52) U.S. Cl.

CPC ..... *H01R 13/6271* (2013.01); *H01R 12/88* (2013.01); *H01R 12/81* (2013.01); *H01R 13/2492* (2013.01)

(58) Field of Classification Search

CPC ..... H01R 13/629; H01R 13/62; H01R 13/62933; H01R 13/193; H01R 23/682; H01R 23/684; H01R 23/6833; H05K 7/1007; H05K 7/1084

USPC ..... 439/341, 342, 376

See application file for complete search history.

(56) References Cited

U.S. PATENT DOCUMENTS

| | | | | |
|---|---|---|---|---|
| 3,436,715 | A * | 4/1969 | Benjamin | 439/77 |
| 3,836,938 | A * | 9/1974 | Barrett et al. | 439/157 |
| 4,082,400 | A * | 4/1978 | Gansert | 439/341 |
| 4,117,310 | A * | 9/1978 | Clark | 219/459.1 |
| 4,969,831 | A * | 11/1990 | Kuzuno et al. | 439/259 |
| 6,250,953 | B1 * | 6/2001 | Niitsu | 439/497 |
| 7,156,678 | B2 * | 1/2007 | Feldman et al. | 439/326 |
| 7,261,580 | B1 * | 8/2007 | Secora | 439/341 |
| 7,331,812 | B2 * | 2/2008 | Nishio et al. | 439/342 |
| 7,354,313 | B2 * | 4/2008 | Kumazawa et al. | 439/638 |
| 7,722,377 | B2 * | 5/2010 | Moore | 439/341 |
| 7,777,132 | B2 * | 8/2010 | Ozawa et al. | 174/50 |
| 7,828,585 | B2 * | 11/2010 | Kurimoto | 439/468 |
| 7,927,122 | B2 * | 4/2011 | Yamaji et al. | 439/342 |
| 8,043,114 | B2 * | 10/2011 | Kaneko et al. | 439/497 |
| 8,647,144 | B2 * | 2/2014 | Wakao et al. | 439/374 |

(Continued)

*Primary Examiner* — Abdullah Riyami
*Assistant Examiner* — Vladimir Imas

(57) ABSTRACT

A kind of electrical connector is disclosed in the present invention, with the electrical connector consisting of: a socket, comprising the first insulator and several first terminals with the first insulator set with the holding space; a plug, comprising the second insulator adaptive to the holding space and several second terminals; a first protrusion is formed on the two sides of the rear end of the holding space in the first insulator respectively with the rear end and front end of the first protrusion formed with the first snap groove and a pivot joint groove respectively; a second protrusion is formed on the two sides of the middle section of the holding space in the first insulator; the second protrusion is formed with a second snap groove at its rear end and provided with the holding groove adaptive to the first protrusion respectively on its both side of the front end, with the front end of the holding groove formed with a first snapping point; the second insulator is provided with steps on its both sides, with the second snapping point on the steps; after the plug is placed in the socket, the holding groove on the plug is engaged with the first protrusion in the socket, the first snapping point and the second snapping point is engaged and localized with the first snap groove and the second snap groove respectively to prevent the plug from retreating out of the socket.

16 Claims, 8 Drawing Sheets

(56) References Cited

U.S. PATENT DOCUMENTS 8,939,794 B2 * 1/2015 Mason et al. ..... 439/581
9,048,569 B2 * 6/2015 Chen
9,048,585 B2 * 6/2015 Lin et al.
2011/0306229 A1 * 12/2011 Katsui et al. ..... 439/345

* cited by examiner

PLUG, SOCKET AND THEIR COMBINED STRUCTURE OF ELECTRICAL CONNECTOR

BACKGROUND OF INVENTION

1. Field of the Invention

The present invention relates to an electrical connector which has a stable structure, convenient assembly and usage, a long service life and stable electrical connection.

2. Background of the Invention

At present, one of the most convenient features of the portable electronic products like the mobile phone (cell phone), Personal Digital Assistant (PDA), notebook computer and digital camera lies in that they can provide the consumers with the non-fixed-point service. Since these electronic products all need to consume the electric power, many electronic products need to be equipped with a battery connected via a connector with the product to supply power to the product.

A Chinese patent discloses a socket connector with the patent number to be 201120485643.1. The socket connector is used to fix and electrically connect a cable plug connector on a circuit board, which includes an insulating housing, having a holding space with an axial section on each side of the holding place; a pair of fixtures, having a first vertical section and a second vertical section and a first welding section and a second welding section extending horizontally from the first vertical section and second vertical section respectively, with the first welding section and second welding section welded to the circuit board and a second fastening section formed between the first vertical section and second vertical section; and a rotary cover body, pivotally connected to the insulating housing, with the rotary cover body set with the interconnected first pivot joint hole and second pivot joint hole in corresponding with the axial section and a snap section in corresponding with the second fastening section of said pair of fixtures.

In the case of said socket connector assembled and used together with the cable plug, place the cable plug connector in said holding space, rotate the rotary cover body so that the rotary cover body covers on the cable plug connector, and then horizontally push the rotary cover body so that the axial section moves from the first pivot joint hole to the second pivot joint hole, and the snap section is snapped into the second fastening section to fix and electrically connect the cable plug connector.

The above-mentioned socket connector has some disadvantages: 1. The assembling and usage of the above-mentioned socket connector and cable plug is very complex, not convenient in application. 2. After the cable plug connector is placed in the holding space of the socket connector and the cable plug is fixed in the socket connector under the synergism of the rotary cover body and the fixtures, since the rotary cover body could be pushed horizontally, the rotary cover body may very likely become loose after a long time of usage, thus, not able to guarantee the long-time coverage of the rotary cover body on the cable plug connector or a stable electrical connection formed between the cable plug connector and the socket connector, and even resulting in the undesirable phenomena of the cable plug connector escaping from the socket connector. 3. Due to the very thin thickness between the bottom surface of the insulating housing in the socket connector and the holding space bottom in the insulating housing and the lack of any reinforcement structure, the port-cracking risk will occur after many times of connection of the socket connector and the cable plug, not able to guarantee the service life of the socket connector.

In addition, there is another kind of socket connector and plug connector on the market that could be plugged in directly for use. Whereas, restricted by the customers' mechanism, the socket corresponding with the socket connector is generally equipped with some parts, causing the socket connector and plug connector unable to be inserted in a parallel manner, but a inclined manner for the assembling. However, because there are no snapping points for the connection of the socket connector and plug connector, when the plug connector is pressed, the risk of the plug connector escaping from the socket connector is quite likely to occur.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

CONTENT OF THE INVENTION

The present invention provides a socket of an electrical connector which has a stable structure, convenient assembly and usage, a long service life and stable electrical connection. The following technical scheme is adopted. The socket of the electrical connector consists of the first insulator and several first terminals fixed in the first insulator where a holding space for the plug insertion is provided, with the raised contact section in the first terminal exposed in the holding space. A first protrusion protruding towards the central position is formed on the two sides of the rear end of the holding space in the first insulator respectively. The front end and rear end of the first protrusion is formed with the first pivot joint section and the first limit section respectively. A second protrusion protruding towards the central position is formed on the two sides of the middle section of the holding space in the first insulator respectively. An interval for the plug insertion is formed between the second protrusion and the first protrusion, with the second limit section formed at the lower end surface end of the second protrusion; after the plug is plugged into said holding space, the first protrusion and the second protrusion would limit the position of the plug to prevent the plug from retreating out.

The present invention provides a plug of an electrical connector which has a stable structure, convenient assembly and usage, a long service life and stable electrical connection. The following technical scheme is adopted. The plug of the electrical connector consists of the second insulator and several second terminals fixed in the second insulator with the contact section of the second terminal exposed on the lower end surface of the second insulator; a holding groove is set respectively on both sides of the front end of said second insulator, with the front end of the holding groove formed with a first clamping location section whose external side protruding outside the that of the second insulator; a step protruding outwards is set in the middle of the two sides of the second insulator respectively, with the second clamping location section on top of the step and the external side of the first clamping location section flush with that of the step; after the second insulator is plugged into the socket, it is engaged and localized with the socket through the first and second clamping location sections formed on the second insulator to prevent the second insulator from retreating out of the socket.

The present invention provides an electrical connector which has a stable structure, convenient assembly and usage, a long service life and stable electrical connection. The following technical scheme is adopted. The electrical connector consists of: a socket, comprising the first insulator and several first terminals fixed in the first insulator where a holding space for the plug insertion is provided, with the raised contact section in the first terminal exposed in the holding space; a plug adaptive to the socket, comprising the second insulator adaptive to the holding space and several second terminals fixed in the second insulator with the contact section of the second terminal exposed on the lower end surface of the second insulator; a first protrusion protruding towards the central position is formed on the two sides of the rear end of the holding space in the first insulator respectively with the front end and rear end of the first protrusion formed with a pivot joint groove and the first snap groove respectively; a second protrusion protruding towards the central position is formed on the two sides of the middle section of the holding space in the first insulator respectively with the second limit section formed on the lower end surface of the second protrusion; the holding groove adaptive to the first protrusion is set respectively on both side of the front end of said second insulator, with the front end of the holding groove formed with a first snapping point, protruding upwards and adaptive to said first snap groove; said second insulator is equipped on both sides a step protruding outwards and adaptive to said second protrusion, with the second snapping point adaptive to the second snap groove on the step; after the second insulator in the plug is placed into the holding space of the first insulator in the socket, the holding groove on the second insulator is engaged with the first protrusion in the first insulator, the first snapping point is engaged and localized with the first snap groove and the second snapping point is engaged and localized with the second snap groove to prevent the plug from retreating out of the socket.

SUMMARY OF THE INVENTION

The present invention is further explained next in combination with the embodiments and the attached drawings.

As shown in FIG. 1, it is a kind of electrical connector consisting of a socket 100 and the plug 200 adaptive to the socket 100.

As shown in FIGS. 2 and 3, said socket 100 includes the first insulator 1 and several first terminals 2 fixed in the first insulator 1 where a holding space 10 for the plug insertion is provided, with the raised contact section in the first terminal 2 exposed in the holding space 10.

In combination with the indication in FIG. 4, a first protrusion 11 protruding towards the central position is formed on the two sides of the rear end of the holding space 10 in the first insulator 1 respectively with the front end and rear end of the first protrusion 11 formed with the first pivot joint section and the first limit section respectively. A second protrusion 12 protruding towards the central position is formed on the two sides of the middle section of the holding space 10 in the first insulator 1 respectively with an interval for the plug insertion formed between the second protrusion 12 and the first protrusion 11, and the second limit section formed at the lower end surface end of the second protrusion 12; after the plug 200 is plugged into said holding space 10, the first protrusion 11 and the second protrusion 12 would limit the position of the plug 200 to prevent the plug 200 from retreating out.

Specifically, the front end of said first protrusion 11 is formed with the pivot joint groove 112 of the first pivot joint section; and the rear end is formed with the first snap groove 111 of the first limit section. The lower end surface end of the second protrusion 12 is formed with the second snap groove 121 of the second limit section.

The rear end of the second protrusion 12 is formed with an inclined-shape guide surface to facilitate guiding the plug 200 to be inserted in the holding space of the socket.

In combination with the indication in FIG. 5, said first insulator 1 is provided with the first metal fork piece 13 at the front end, with the first metal fork piece 13 comprising: a main-body section 131 and the first snap section 132 and the second snap section 133 formed on both ends of the main-body section 131, with the first snap section 132 and the second snap section 133 equipped with the first weld leg 134 and the second weld leg 135 respectively at their external ends. There is a notch 102 set at the front end of holding space 10 of said first insulator 1; the first insulator 1 is also provided with first snapping location 101 on the both sides of the front end respectively; and there is the first clamp protrusion 103 in the first snapping location 101. Said first snap section 132 and second snap section 133 are both in an inverted "U" shape; and a first hole location 136 adaptive to the first clamp protrusion 103 is provided in the first snap section 132 and the second snap section 133 respectively.

In the case of assembling the first metal fork piece 13, the main-body section 131 of the first metal fork piece 13 is held in the notch 12 at the front end of the first insulator 1 to increase the size of holding space 10; the first snap section 132 and the second snap section 133 in the first metal fork piece 13 is snapped at the first snapping location 101 on both sides of the front end of the first insulator 1 respectively; and the first hole location 136 in the first snap section 132 and the second snap section 133 is nested with said first clamp protrusion 103 respectively to fix the first metal fork piece 13 at the front end of the first insulator 1. Moreover, in the case of assembling the socket 100 and the circuit board, the first weld leg 134 and the second weld leg 135 at both ends of the first metal fork piece 13 are also welded to the circuit board, not only reinforcing the stability of the socket 100 and the circuit board but also that of the structure of the socket 100.

The aforementioned first metal fork piece 13 could effectively prevent from the front-end cracking of the holding space 10 in the socket 100 after many times of connection of the socket 100 and the plug 200 to effectively improve the service life of the socket 100.

The rear end surface of the first insulator 1 is provided forward with multiple said first terminal holes 104 going through said holding spaces 10; and the rear end of the first insulator 1 is provided with the second metal fork piece 14 wrapping on the upper end surface and the two side surfaces at the rear end of the first insulator 1 and located right on top of the first terminal holes 104. Such a structure could effectively reinforce said first terminal holes 104 and prevent from the collapse of the first terminal holes 104. Specifically, the rear end of the first insulator is provided with the second snapping location 105 for assembling said second metal fork piece 14; and the third snap groove 106 is formed in the second snapping location 105. Said second metal fork piece 14 includes: a main-body section 141, the snapping section 142 formed by bending downwards along the two ends of the main-body section 141, and the third weld leg 143 formed by bending upwards along the rear end of the snapping section 142 and parallel to the main-body section 141, with the barb piece 144 adaptive to said third snap groove 106 provided in the snapping section 142.

Said first terminal 2 includes a one-piece body 21, the pin section 23 and the contact section 22 where the contact section 22 has a strip-shaped opening so that the contact section 22 is divided into two parts, and the end of each part is formed with a bump section 221 distributed in a side-by-side manner.

Said socket 200 has the following two kinds of structures:

The first kind of structure: in combination with the indication in FIGS. 6 and 7, said socket 200 comprises: a said holding space 10 adaptive to the second insulator 3 and several second terminals 4 fixed in the second insulator 3, with the contact section of second terminal 4 exposed on the lower end surface of the second insulator 3 and the pin section of the second terminal 4 fixed with the cable 6.

The holding groove 31 adaptive to the first protrusion 11 is set respectively on both side of the front end of said second insulator 3, with the front end of the holding groove 31 formed with a first clamping location section whose external side protrudes outside that of the second insulator 3. Specifically, the front end of the holding groove 31 is formed with an upward protrusion serving as the first snapping point 311 of said first clamping location section, with the first snapping point 311 adaptive to the first snap groove 111.

The step 32 protruding outwards and adaptive to said second protrusion 12 is set on both sides of the second insulator 3, with the external side of the step flush with that of the first clamping location section and the second clamping location section matching with the second snap groove 121 on top of the step 32; specifically, said step 32 is formed with an upward protrusion serving as the second snapping point 121 of said second clamping location section. After the second insulator 3 in the socket 200 is placed in the holding space 10 of the first insulator 1 in the socket 100, the holding groove 31 on the second insulator 3 is engaged with the first protrusion 11 in the first insulator 1; the first snapping point 311 is engaged and localized with the first snap groove 111; and the second snapping point 321 on the step 32 is engaged and localized with the second snap groove 121 to prevent the plug 200 from retreating out of the socket 100.

The section of the step 32 is a of an "L" shape.

In combination with the indication in FIG. 8, the lower end face of said second insulator 3 is provided with multiple terminal grooves 301 to hold the contact section in said second terminal 4; the rear end surface of the second insulator 3 is provided forward with the second terminal hole 302 going through the terminal groove 301; and the upper end surface of the second insulator 3 is provided downward with the location hole 304 going through said terminal groove 301.

has a rear end face 301 through the terminal grooves of the second terminal hole 302, and the second insulator opened a hole through the terminal groove 301 positioned under three upper face 304.

Said second terminal 4 includes: a body 41 and the contact section 42 and pin section 43 formed at the front and rear end of the body 41 respectively where the contact section 42 is formed with a downward protruding barb 421 on its lower end surface and is engaged and localized with the location hole 304 provided in said second insulator 3 through the barb 421; the pin section 43 includes: the first clad section 431 and the second clad section 432 at the rear end of body 41 with the cable 6 fixed through the first clad section 431 and the second clad section 432. Specifically, the cable 6 includes the metal core section 61 and the covering section 62 covering on the periphery of the metal core section 61, with a part of the front end of the metal core section 61 exposed outside the covering section 62. The specification of said first clad section 431 is greater than that of the second clad section 432 where the first clad section 431 is used to clad the covering section 62 in the cable 6; and the second clad section 432 is used to clad the metal core section 61 in the cable.

The second structure: the differences between the plug 200 of this structure and that of the above-mentioned structure lie in: the structures of the second terminals 4 in the plug 200 are different. Specifically and in connection with the indication in FIGS. 9-11, said second terminal 4 includes: a body 41 and the contact section 42 and pin section 43 formed at the front and rear end of the body 41 respectively where the pin section 43 is a 4-weld-leg structure bending downward and then upward along the rear end of the body 41 till it is parallel with the body 41, and is led and connected to the FPC board 5 through said weld leg structure, as shown in FIG. 12.

In addition, said second insulator 3 is installed with a third metal fork piece 33 on the side provided with the second terminal holes, with the third metal fork piece 33 located right on top of the second terminal holes and wrapping on the upper end surface and the two side surfaces at the rear end of the second insulator 3. Such a structure could effectively reinforce said second terminal holes and prevent from the collapse of the second terminal holes. Specifically, the rear end of said second insulator 3 is provided with the third snapping location 303 for assembling said third metal fork piece 33. Said third metal fork piece 33 includes: a main-body section 331, the snapping section 332 formed by bending downwards along the two ends of the main-body section 331, and the fourth weld leg 333 formed by bending upwards along the rear end of the snapping section 332 and parallel to the main-body section 331, with the barb piece 334 used for localization provided in the snapping section 332.

Except for the aforementioned differences, the second structure is consistent with the first structure, which will not be repeated here.

The assembling and application method of said electrical connector comprises the following steps:

Step 1: in connection with the indication in FIG. 13, insert said front end of plug 200 aslant into the holding space 100 of socket 100 along the front end of the first protrusion 11 in the socket 100. At this point, the first snapping point 311 at the front end of plug 200 is connected with the pivot joint groove 112 at the front end of the first protrusion 11 in the socket 100 to form a rotatable supporting point.

Step 2: in connection with the indication in FIG. 14, turn said plug 200 downwards until it is parallel with the socket 100 where the contact section of the second terminal 4 in the plug 20 contacts with the raised contact section 22 of the first terminal 2 in the plug 200.

Step 3: in connection with the indication in FIG. 15, press said plug 200 downwards in a vertically manner so that the first snapping point 311 at the front end of the plug 200 leaves the pivot joint groove 112 at the front end of the first protrusion 11 in the socket, with the contact section 22 in the first terminal 2 having the upward restoring force when it is deformed and pressed.

Step 4: in connection with the indication in FIG. 16, push said plug 200 horizontally to nest the holding grooves 31 on the both sides of the front end of the second insulator 3 in the plug 200 on the lower end of the first protrusion 11 in the first insulator 1 and until the front end of the second insulator 3 moves against to the rear end of the holding space 10 in the socket 100.

Step 5: in connection with the indication in FIG. 17, let go the plug 200, then the plug 200 moves upward under the action of the restoring force of the contact section 22 in the first terminal 2, causing the first snapping point 311 at the front end of the holding groove 31 in the second insulator 3 and the second snapping point 321 on the step 32 to be engaged and localized with the first snap groove 111 and the second snap groove 121 in the socket 100 respectively to form a stable assembly of the plug 200 and socket 100 and prevent the plug 200 from retreating out of the socket 100.

DETAILED DESCRIPTION OF THE INVENTION

Figure 1:
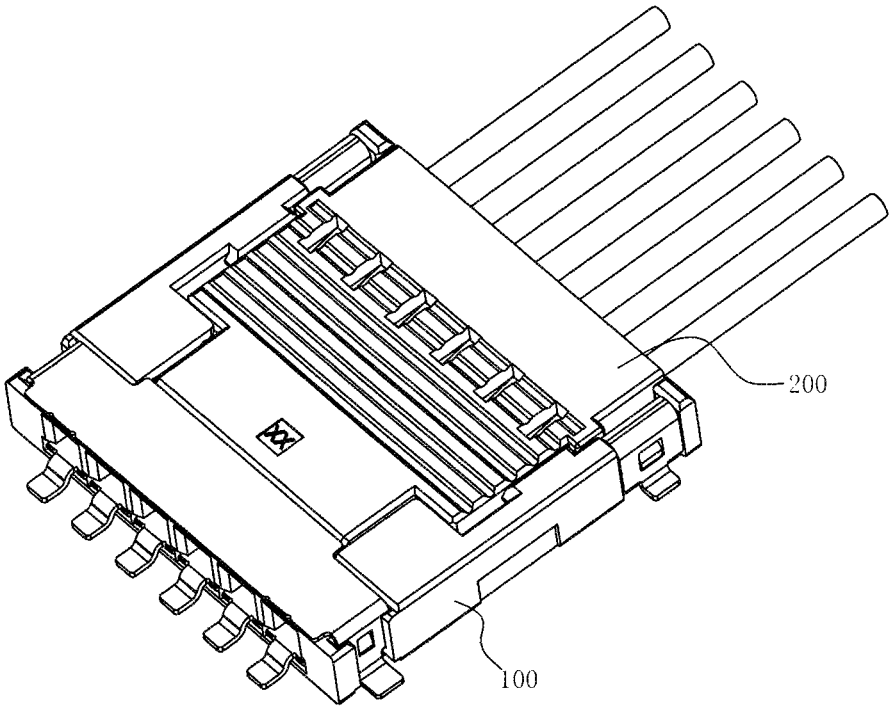
FIG. 1 is the structural schematic diagram of the present invention.
Figure 2:
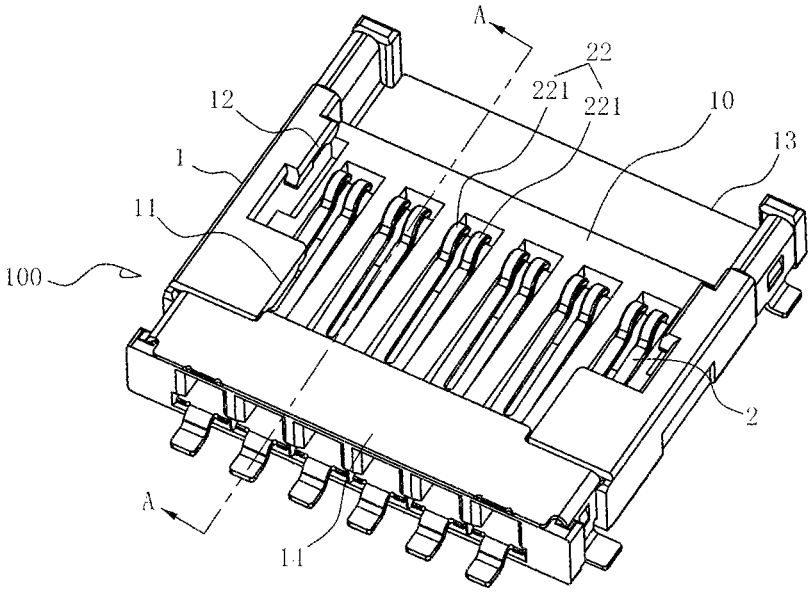
FIG. 2 is the stereogram of the socket of the present invention.
Figure 3:
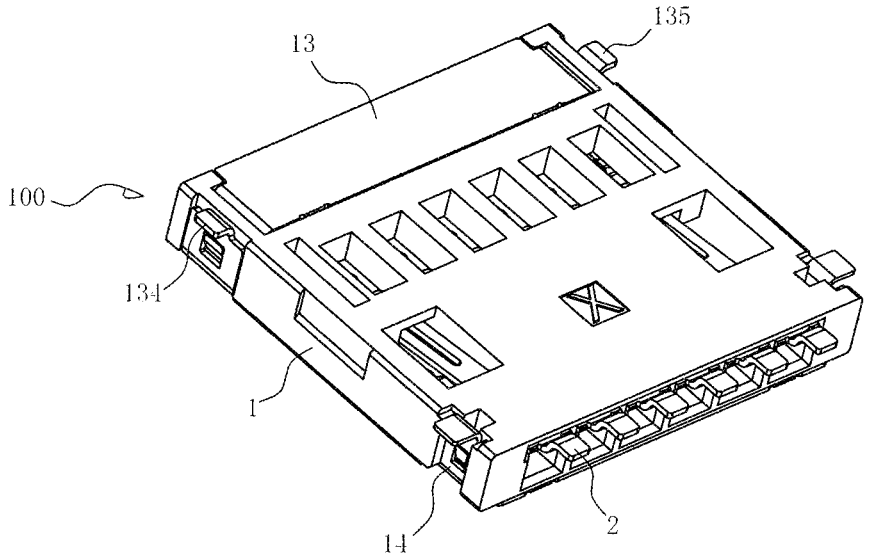
FIG. 3 is the stereogram of the socket of the present invention in another perspective.
Figure 4:
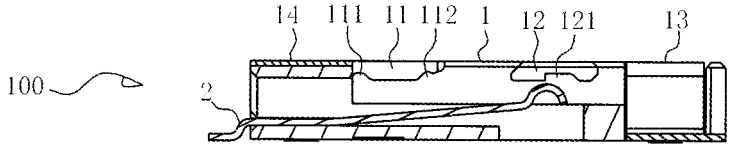
FIG. 4 is the section view of those in FIG. 2 in the A-A direction.
Figure 5:
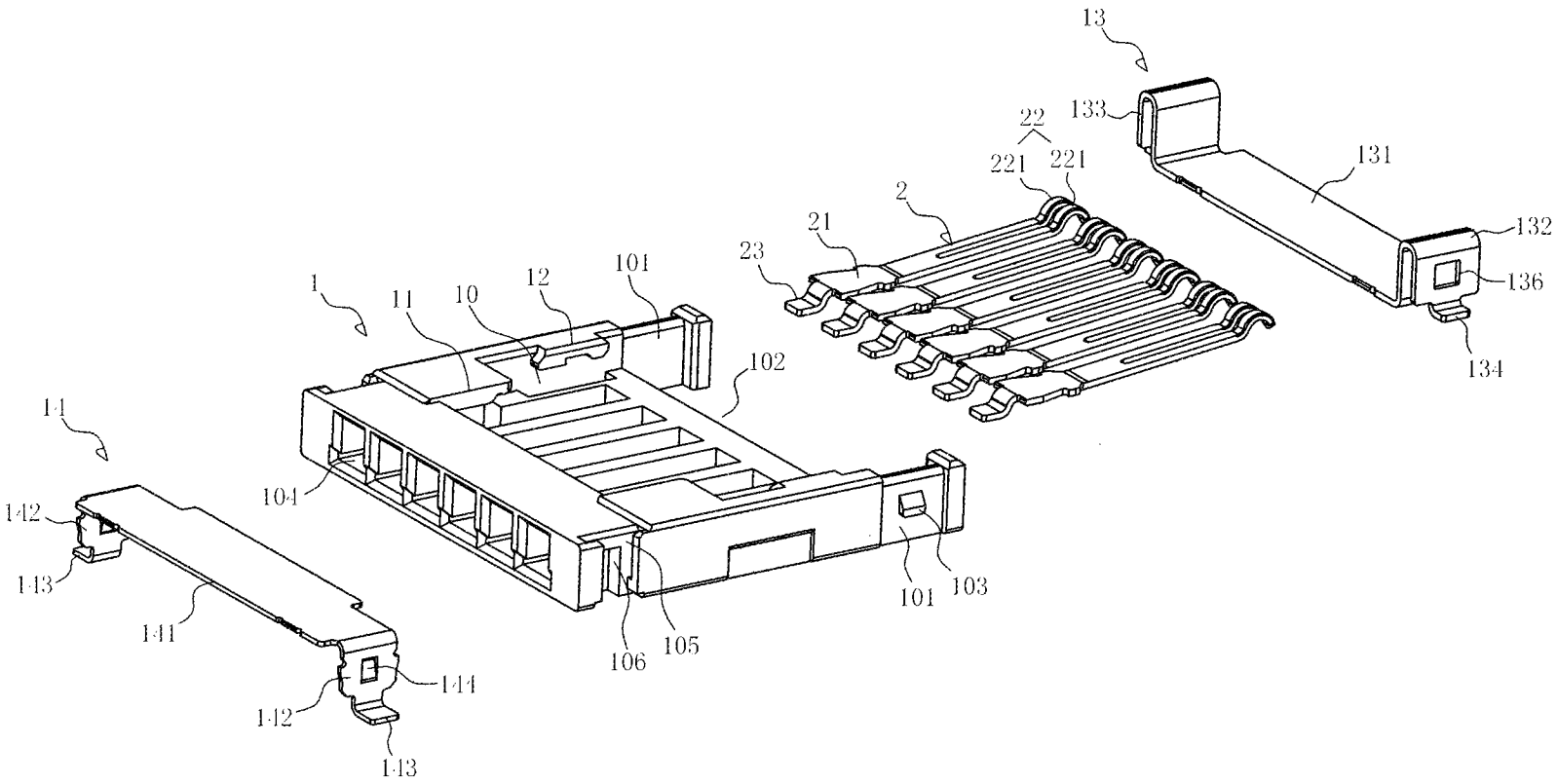
FIG. 5 is the deposition stereogram of the socket of the present invention.
Figure 6:
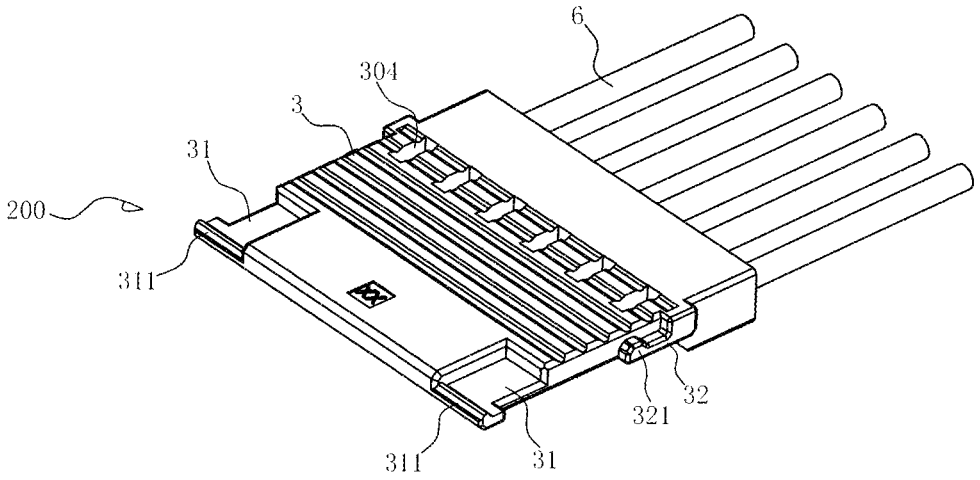
FIG. 6 is the stereogram of the plug of the first structure of the present invention.
Figure 7:
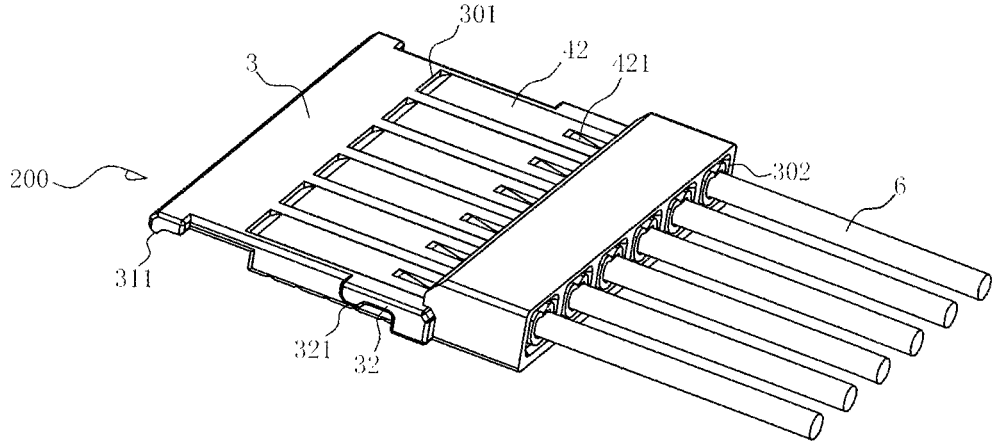
FIG. 7 is the stereogram of the plug of the first structure of the present invention in another perspective.
Figure 8:
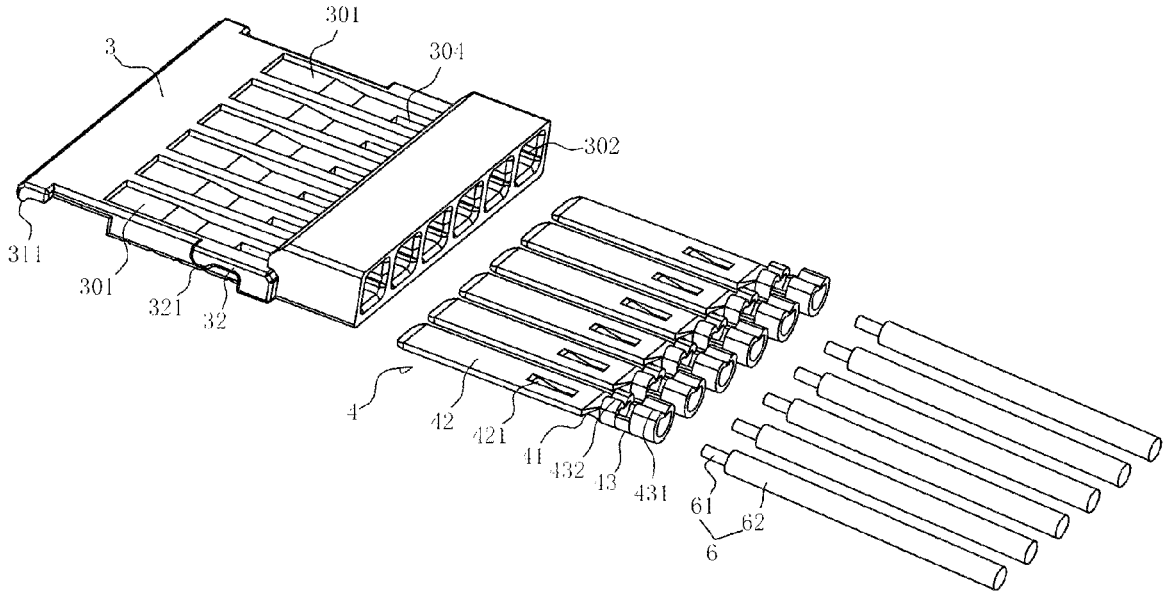
FIG. 8 is the deposition stereogram of the plug of the first structure of the present invention.
Figure 9:
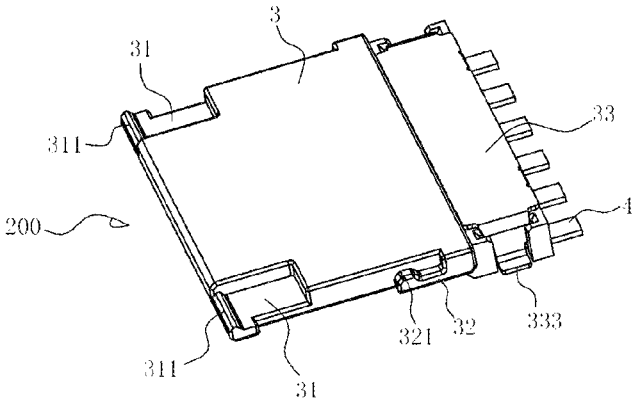
FIG. 9 is the stereogram of the plug of the second structure of the present invention.
Figure 10:
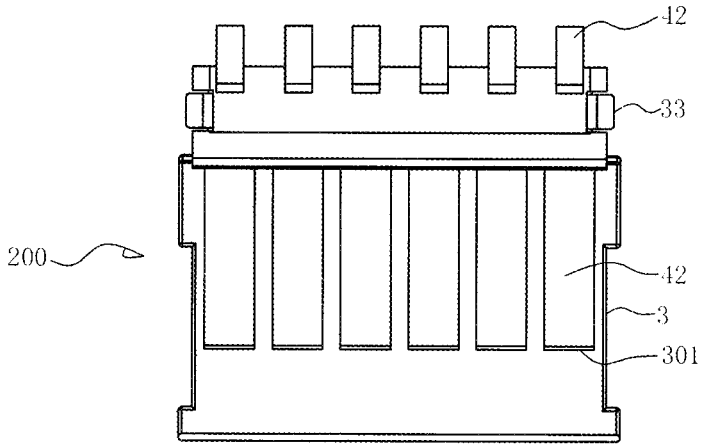
FIG. 10 is the principal view of the plug of the second structure of the present invention.
Figure 11:
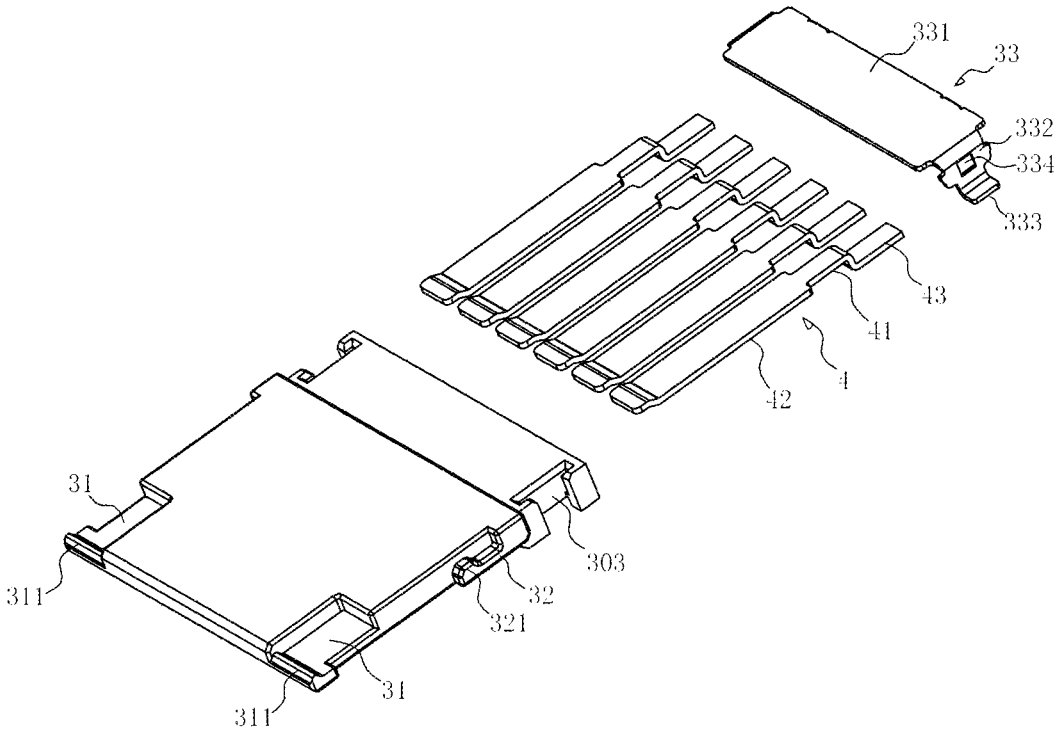
FIG. 11 is the deposition stereogram of the plug of the second structure of the present invention.
Figure 12:
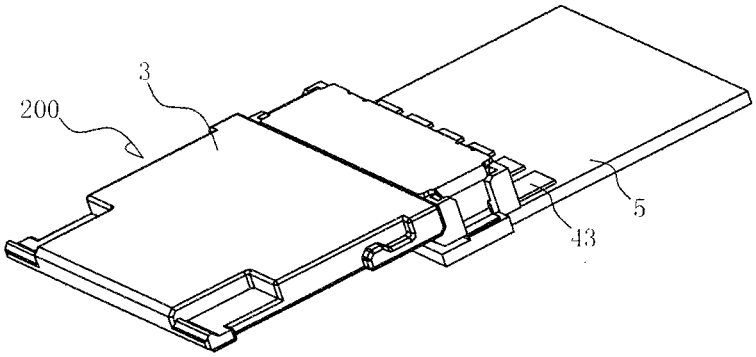
FIG. 12 is the schematic diagram of the assembly of the plug and FPC board of the second structure of the present invention.
Figure 13:
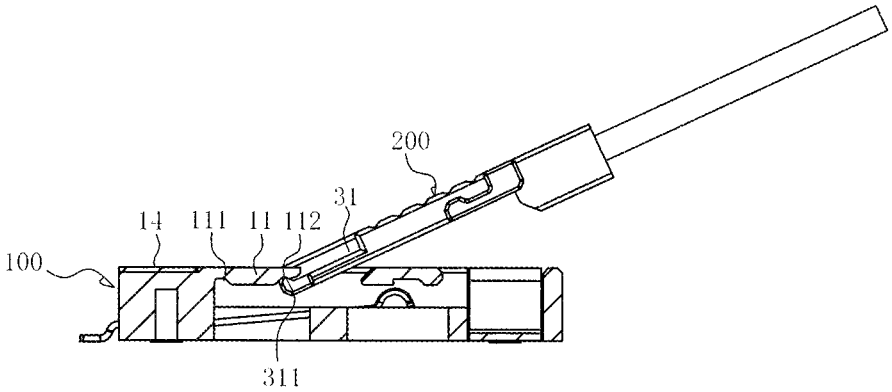
FIG. 13 is the schematic diagram of Step 1 of the assembling and application method of the present invention.
Figure 14:
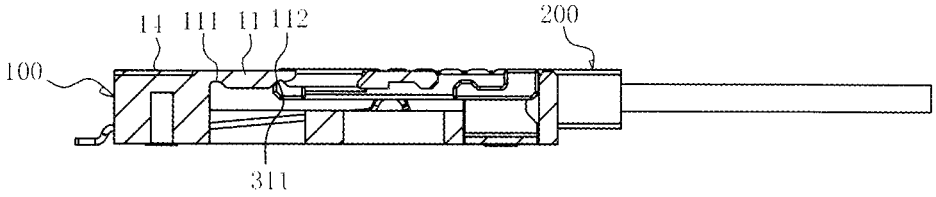
FIG. 14 is the schematic diagram of Step 2 of the assembling and application method of the present invention.
Figure 15:
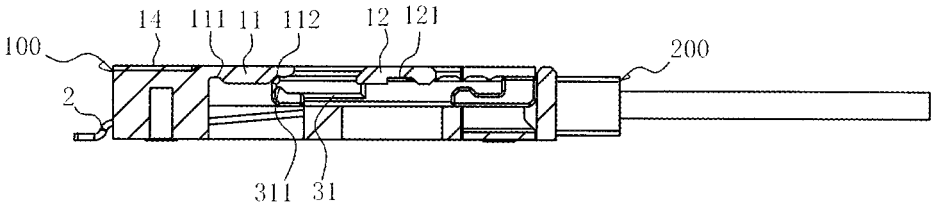
FIG. 15 is the schematic diagram of Step 3 of the assembling and application method of the present invention.
Figure 16:
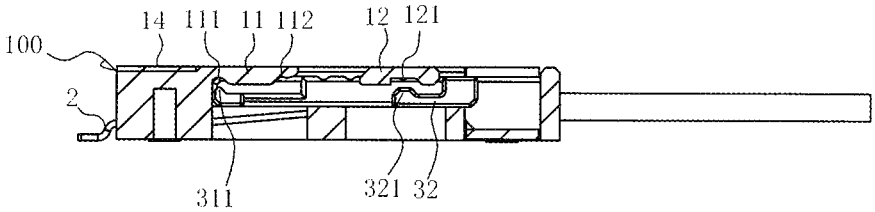
FIG. 16 is the schematic diagram of Step 4 of the assembling and application method of the present invention.
Figure 17:
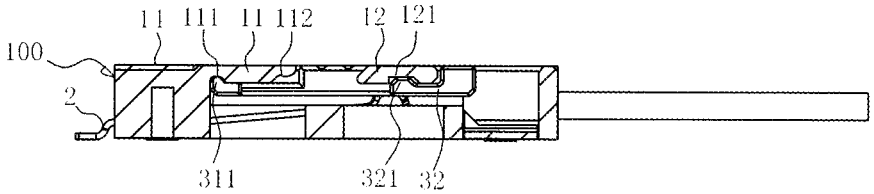
FIG. 17 is the schematic diagram of Step 5 of the assembling and application method of the present invention.

After adopting the above-described technical scheme, the present invention compared with the prior art has the following effects:

1. The assembling and application method of the electrical connector of the present invention is very simple and easy to operate that can effectively improve the assembly efficiency.

2. The socket is provided with a pair of the first protrusion and second protrusion used to prevent the plug from moving after it is inserted in the holding space; the plug is provided with the first snapping point and the second snapping point adaptive to the first protrusion and second protrusion respectively so that after the plug is inserted in the holding space of the socket, the first snapping point and the second snapping point is engaged and localized with the first protrusion and second protrusion respectively, able to prevent the plug from retreating out of the socket unexpectedly and form the stable electrical connection after the plug and socket is connected.

3. The socket limits the plug inserted into the holding space by utilizing the formed parts in the first insulator instead of assembling some external structure on the first insulator to limit the plug, which can effectively simplify the structure of the present invention, save costs and improve market competitiveness.

4. The front and rear end of the first insulator in the socket is provided with the first metal fork piece and the second metal fork piece respectively used to reinforce the front end of the first terminal hole and holding space, which can effectively improve the service life of the present invention.

I claim:

1. A socket of an electrical connector, comprising a first insulator and several first terminals fixed in the first insulator where a holding space for a plug insertion is provided, with a raised contact section in the first terminal exposed in the holding space;

the characteristics lie in that a first protrusion protruding towards a central position is formed on the two sides of a rear end of the holding space in the first insulator respectively with a front end and rear end of the first protrusion formed with a first pivot joint section and a first limit section respectively; a second protrusion protruding towards the central position is formed on the two sides of a middle section of the holding space in the first insulator respectively with an interval for the plug insertion formed between the second protrusion and the first protrusion, and a second limit section formed at a lower end surface end of the second protrusion; after the plug is plugged into said holding space, the first protrusion and the second protrusion would limit the position of the plug to prevent the plug from retreating out;

wherein the front end of the first protrusion is formed with a pivot joint groove of the first pivot joint section; and the rear end is formed with a first snap groove of the first limit section; the lower end surface of a second protrusion is formed with the second snap groove of the second limit section.

2. The structure defined in claim 1, wherein the rear end of the second protrusion is formed with an inclined-shape guide surface for the convenience of the plug insertion.

3. The structure defined in claim 1, wherein the first insulator is provided with a first metal fork piece at the front end, with the first metal fork piece comprising: a main-body section and a first snap section and a second snap section formed at both ends of a main-body section where the first snap section and the second snap section is engaged at a first snapping location on the both sides of the first insulator respectively; the main-body section is placed at the bottom of the holding space; and the first snap section and the second snap section is equipped with a first weld leg and a second weld leg respectively at their external ends.

4. The structure defined in claim 3, wherein a first clamp protrusion is formed on both sides of the front end of the first insulator respectively; a first hole location adaptive to the first clamp protrusion is provided in the first snap section and the second snap section respectively; and said first snap section and second snap section are both in an inverted "U" shape.

5. The structure defined in claim 1, wherein the rear end surface of the first insulator is provided forward with multiple first terminal holes going through said holding space; and the rear end of the first insulator is provided with a second metal fork piece wrapping on the upper end surface and the two side surfaces at the rear end of the first insulator and located on top of the first terminal holes.

6. The structure defined in claim 5, wherein the rear end of the first insulator is provided with a second snapping location for assembling said second metal fork piece; and a third snap groove is formed in the second snapping location; a second metal fork piece includes: a main-body section; the snapping section formed by bending downwards along the two ends of the main-body section, and a third weld leg formed by bending upwards along the rear end of the snapping section, with a barb piece adaptive to said third snap groove provided in the snapping section.

7. The structure defined in claim 1, wherein the contact section in the first terminal contains two bump sections distributed in a side-by-side manner.

8. A plug of the electrical connector, comprising the second insulator and several second terminals fixed in the second insulator with the contact section of the second terminal exposed on the lower end surface of the second insulator;

the characteristics lie in that a holding groove is set respectively on both sides of the front end of said second insulator, with the front end of the holding groove formed with a first clamping location section whose external side protruding outside the that of the second insulator; a step protruding outwards is set in the middle of the both sides of the second insulator, with a second clamping location section on top of the step and the external side of the first clamping location section flush with that of the step; after the second insulator is plugged into the socket specified under the patent claim 1, it is engaged and localized with the socket under the patent claim 1 through the first and second clamping location sections formed on the second insulator to prevent the second insulator from retreating out of the socket.

9. The structure defined in claim 8, wherein the front end of the holding groove is formed with an upward protrusion serving as a first snapping point of said first clamping location section; said step is formed with an upward protrusion serving as a second snapping point of said second clamping location section.

10. The structure defined in claim 8, wherein the section of the step is a of an "L" shape.

11. The structure defined in claim 8, wherein a lower end face of said second insulator is provided with multiple terminal grooves to hold the contact section in said second terminal; the rear end surface of the second insulator is provided forward with a second terminal hole going through the terminal groove; and the upper end surface of the second insulator is provided downward with a location hole going through said terminal groove.

12. The structure defined in claim 11, wherein the second terminal includes: a body and the contact section and a pin section formed at the front and rear end of the body respectively where the contact section is formed on its lower end surface with a barb protruding downwards and engaged and localized with the location hole provided in said second insulator through the barb; the pin section includes: a first clad section and a second clad section formed at the rear end of the body; and the cable is fixed through the first clad section and the second clad section.

13. The structure defined in claim 11, wherein the second terminal includes: the body fixed in the second insulator and the contact section and the pin section formed at the front and rear end of the body respectively where the pin section is a weld leg structure bending downward and then upward along the rear end of the body till it is parallel with the body, and is led and connected to a FPC board through said weld leg structure.

14. The structure defined in claim 13, wherein said second insulator is installed with a third metal fork piece on the side provided with the second terminal holes, with the third metal fork piece located right on top of the second terminal holes and wrapping on the upper end surface and the two side surfaces at the rear end of the second insulator.

15. The structure defined in claim 14, wherein the rear end of the second insulator is provided with a third snapping location for assembling said third metal fork piece; said third metal fork piece includes: a main-body section, the snapping section formed by bending downwards along the two ends of the main-body section, and a fourth weld leg formed by bending upwards along the rear end of the snapping section and parallel to the main-body section, with the barb piece used for localization provided in the snapping section.

16. A electrical connector, consisting of:

a socket comprising a first insulator and several first terminals fixed in the first insulator where a holding space for a plug insertion is provided, with a raised contact section in the first terminal exposed in the holding space;

a plug adaptive to the above-mentioned socket, comprising a second insulator adaptive to the holding space and several second terminals fixed in the second insulator with a contact section of the second terminal exposed on a lower end surface of the second insulator;

the characteristics lie in that a first protrusion protruding towards the central position is formed on the two sides of the rear end of the holding space in the first insulator respectively with the front end and rear end of the first protrusion formed with a pivot joint groove and a first snap groove respectively; a second protrusion protruding towards the central position is formed on the two sides of a middle section of the holding space in the first insulator respectively with a second limit section formed on the lower end surface of the second protrusion; a holding groove adaptive to the first protrusion is set respectively on both side of the front end of said second insulator, with the front end of the holding groove formed with a first snapping point, protruding upwards and adaptive to said first snap groove; said second insulator is equipped on both sides a step protruding outwards and adaptive to said second protrusion, with a second snapping point adaptive to a second snap groove on the step; after the second insulator in the plug is placed into the holding space of the first insulator in the socket, the holding groove on the second insulator is engaged with the first protrusion in the first insulator, the first snapping point is engaged and localized with the first snap groove and the second snapping point on the step is engaged and localized with the second snap groove to prevent the plug from retreating out of the socket.

* * * * *